United States Patent [19]

Bänziger et al.

[11] 4,326,943

[45] Apr. 27, 1982

[54] ELECTRODE IN WATER ELECTROLYSIS

[75] Inventors: Robert Bänziger, Wettinghen; Roland Isenschmid, Veltheim; Anton Menth, Nussbaumen; René Müller, Fislisbach; Samuel Stucki, Baden, all of Switzerland

[73] Assignee: BBC Brown, Boveri & Company, Limited, Baden, Switzerland

[21] Appl. No.: 162,955

[22] Filed: Jun. 25, 1980

[30] Foreign Application Priority Data

Jun. 29, 1979 [CH] Switzerland ..... 6083/79

[51] Int. Cl.[3] ..... C25B 11/02; C25B 11/08; C25B 11/10; C25B 1/00

[52] U.S. Cl. ..... 204/290 F; 204/284; 204/291

[58] Field of Search ..... 204/282–284, 204/290 F, 291

[56] References Cited

U.S. PATENT DOCUMENTS

| | | | |
|---|---|---|---|
| 1,470,577 | 10/1923 | Liebknecht | 204/284 |
| 2,812,301 | 11/1957 | Rideal et al. | 204/153 |
| 3,810,770 | 5/1974 | Bianchi et al. | 204/290 F X |
| 4,110,180 | 8/1978 | Nidola et al. | 204/128 |
| 4,125,449 | 11/1978 | Lewis et al. | 204/290 F |
| 4,157,943 | 6/1979 | Scarpellino et al. | 204/37 R |
| 4,211,627 | 6/1980 | Cunningham | 204/252 |

FOREIGN PATENT DOCUMENTS

| | | | |
|---|---|---|---|
| 7037140 | 11/1970 | Japan | 204/290 F |

*Primary Examiner*—F. Edmundson

*Attorney, Agent, or Firm*—Oblon, Fisher, Spivak, McClelland & Maier

[57] ABSTRACT

An improved electrode for the electrolysis of water comprising a porous sinter plate of titanium or a titanium alloy having on one surface a coating of a finely divided catalyst comprising a mixture of ruthenium oxide and iridium oxide. In a preferred embodiment, the electrode has on its outer margin a dense, non-porous zone having a smooth appearance.

8 Claims, 5 Drawing Figures

ELECTRODE IN WATER ELECTROLYSIS

BACKGROUND OF THE INVENTION

1. Field of the Invention

The present invention relates to electrodes for electrolysis of water.

2. Description of the Prior Art

Electrodes for the electrolysis of water are well known in the art. Such electrodes as well as processes for their production evolved from the technology developed for fuel cells. Such cells are described, for example by Carl Berger, Handbook of Fuel Cell Technology, pages 401–406, Prentice Hall 1968 and H. A. Liebafsky and E. J. Cairns, Fuel Cells and Fuel Batteries, pages 289–294, John E. Wiley and Sons, 1968. The demand for exactly defined reaction zones requires a multi-layer structure and special treatment processes of such fuel cell electrodes.

The above described electrodes, however, are too complicated and their production methods too complex and expensive for use in the electrolysis of water. This applies in particular to production methods utilized in large industrial plants for the production of hydrogen on an efficient and economical basis.

Electrodes specifically constructed for the electrolysis of water are likewise known in the art. For example, LaConti et al U.S. Pat. No. 4,039,409 describes an electrode for electrochemical systems such as electrolysis and oxygen concentrator cells which contain an active reduced platinoid electrocatalyst comprising platinum oxide and from 5 to 60% ruthenium oxide. The catalytic electrode and cathode are positioned on opposite sides of a cationic exchange membrane.

Various methods of forming metal electrodes are likewise known in the art. For example, Alfenaar et al, U.S. Pat. No. 4,127,468 describes a method for preparing a metal electrode wherein a basis metal electrode is contacted with a solution of an alloying element compound which is reduced in situ to form the free alloying element which forms an alloy with the basis-metal.

The electrodes described above, as well as those presently utilized commercially, leave much to be desired with regard to their mechanical and chemical properties. This applies generally also with regard to the catalysts presently used.

SUMMARY OF THE INVENTION

Accordingly, it is an object of the invention to provide an electrode for the electrolysis of water which has improved mechanical and chemical stability.

It is another object of the invention to provide an electrode for the electrolysis of water which has a high electrical conductivity and good permeability for water and gas.

It is a further object of the invention to provide an electrode for the electrolysis of water which has a markedly high corrosion resistance in an oxidizing environment and therefore is particularly useful as the electrode for the collection of oxygen in a conventional electrolysis system.

These and other objects as will hereafter become clearer from the following discussion and appended drawings have been attained by an electrode comprising a porous sinter plate of titanium or a titanium alloy having on one surface a coating of a finely particulate catalyst comprising a mixture of ruthenium oxide and iridium oxide.

DETAILED DESCRIPTION OF THE INVENTION

The present invention relates to an improved electrode for the electrolysis of water. The electrode of the invention, due to its economy of production, is particularly well suited for the electrolysis of water in large scale industrial applications. The electrode of the invention will be best understood from the following description taken in connection with the accompanying drawings in which.

Figure 1:
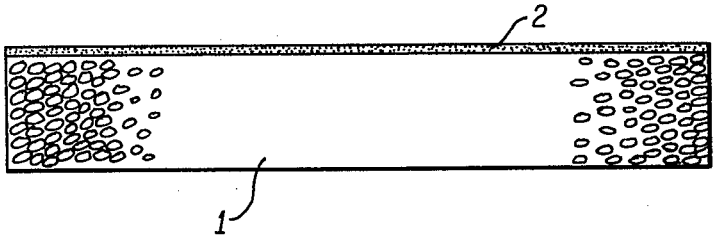
FIG. 1 is a cross-sectional view of the electrode of the present invention.

In FIG. 1 of the drawings, there is shown a cross-sectional view of the electrode of the invention which comprises a porous sinter plate or body 1 of titanium or a titanium alloy. On one surface of the sinter plate 1 is a coating of a finely particulate catalyst 2 comprising a mixture of ruthenium oxide and iridium oxide.

Figure 2:
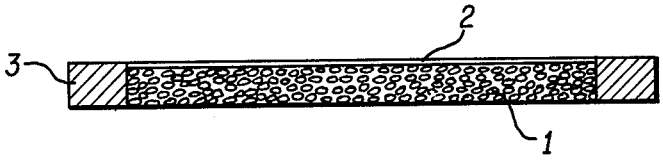
FIG. 2 is a cross-sectional view of a perferred embodiment of the present invention.

In FIG. 2, a preferred embodiment of the electrode of the present invention is illustrated. In this embodiment, the electrode comprises a porous sinter plate or body 1 having a coating of a finely particulate catalyst 2 and, at the outer margin, a dense non-porous zone 3 having a smooth appearance. As is apparent from the drawing, the coating of finely particulate catalyst 2 does not extend over the dense, non-porous zones.

Figure 3:
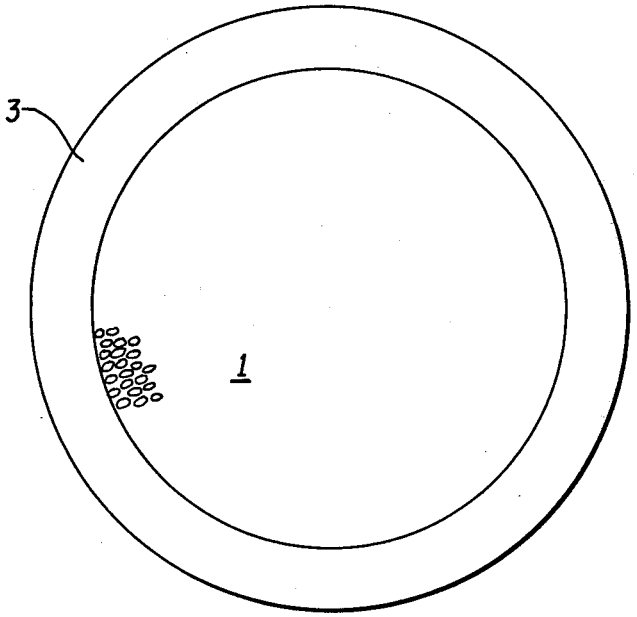
FIG. 3 is a plan view of the embodiment shown in FIG. 2, with a portion shown in section.

FIG. 3 shows the embodiment of FIG. 2 in plain view with a portion shown in section thus illustrating the contrast between the dense, non-porous margin and the porous sinter plate 1.

In the embodiment illustrated in FIGS. 2 and 3, the dense, non-porous zone 3 is comprised of the same material as the porous sinter plate or body 1, i.e., titanium or a titanium alloy. The dense zone 3 is manufactured by methods conventional in the art.

Figure 4:
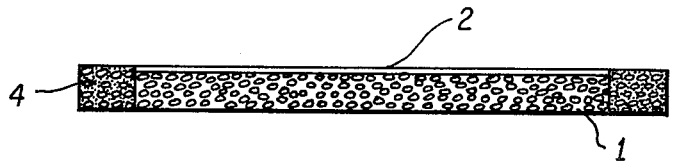
FIG. 4 is a cross-sectional view of a variation of the preferred embodiment shown in FIG. 2; and, FIG. 5 is a plan view of the embodiment shown in FIG. 4 with portions shown in section.

FIG. 4 shows a cross-sectional view of a variation of the embodiment of FIGS. 2 and 3, having a dense, non-porous zone having a smooth appearance at the margin of the porous sinter plate 1 having a coating of finely particulate catalyst 2. In FIG. 4, the dense, non-porous zone 3 is formed by impregnation of the margin of the porous sinter plate 1 with a suitable, inert plastic 4. The dense, non-porous zone is formed as in the embodiment illustrated in FIGS. 2 and 3, by impregnating the pores of the porous sinter plate 1.

In the embodiment shown in FIG. 4, the pores are impregnated with a suitable plastic. Impregnation under vacuum and finally heating are carried out in the manner described with regard to FIGS. 2 and 3 to form a marginal zone having a smooth appearance. As is the case with the embodiment illustrated in FIGS. 2 and 3, a number of applications of the plastic to the marginal zone followed by exposure to vacuum are necessary to assure that complete impregnation is achieved.

Figure 5:
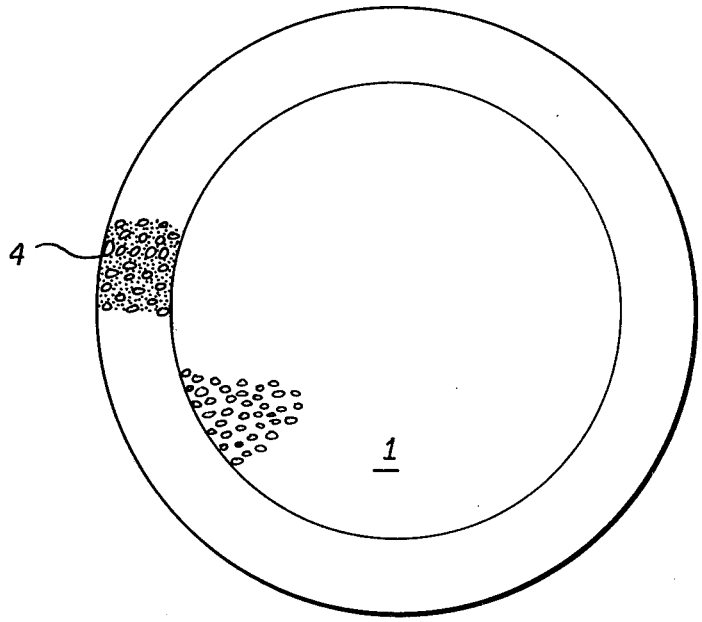

FIG. 5 shows the embodiment of FIG. 4 in plan view with portions in section thus illustrating the contrast between the dense, non-porous margin 3 and the porous sinter plate 1 as well as the plastic impregnated 4 in the dense, non-porous margin 3.

The plastic material 4 utilized to impregnate the pores of the porous sinter plate 1 to form the dense, non-porous margin 3 is a plastic inert to the conditions under which the subject electrode will be utilized. A preferred plastic is a fluorocarbon, particularly polytetraflouroethylene. Other suitable plastic materials include certain epoxy resins which are inert to the conditions necessary for the electrolysis of water. Wherein polytetraflouroethylene is utilized as the impregnating plastic, the electrode is preferably heated to a temperature of about 375° C. after impregnation is completed to solidify the marginal zone and give it a smooth appearance.

It will be understood that the shape of the subject electrode is represented in the drawings as being circular merely for purposes of illustration and that it can likewise be of any other suitable shape, such as, for example, triangular, square, rectangular, hexagonal, octagonal and the like. In large industrial operations a square configuration is particularly preferred as it permits a simple cell structure similar to a filter press.

The porous plate of the subject electrode is comprised of titanium or a titanium alloy, preferably an alloy of titanium, aluminium and vanadium. A particularly preferred alloy comprises 90% by weight titanium, 6% by weight aluminium and 4% by weight vanadium. The porous sinter plate is formed by conventional sintering techniques, preferably from titanium or an alloy thereof having a particle size of from about 50 microns to about 150 microns. Advantageously, the porous sinter plate is formed in a suitable die at the temperature above 800° C. and at a pressure of about 75 bar under an inert atmosphere, preferably an argon atmosphere.

The porous sinter plate 1 is coated on one side with a finely particulate catalyst comprising a mixture of ruthenium oxide and iridium oxide. A preferred catalyst is a mixture of 20 molar % ruthenium oxide and 80 molar % iridium oxide.

The finely particulate catalyst is advantageously coated onto the porous sinter plate as an impregnate in a suitable inert material. A preferred material is a fluorocarbon polymer. Particularly preferred is polytetrafluoroethylene.

The incorporation of a finely particulate platinum metal oxide catalyst into an inert fluorocarbon polymer and use of the resulting homogeneous mixture as a catalytic coating for electrodes is known in the art, for example, in DeCraene U.S. Pat. No. 3,798,063 and U.S. Pat. No. Re. 29,419. Typical fluorocarbon polymers useful to form such coating include polyvinyl fluoride, polyvinylidene fluoride, polytetrafluoroethylene, polyhexafluoroethylene and the like.

It is preferred in accordance with the invention to homogeneously blend the finely particulate catalyst with polytetrafluoroethylene and disperse the mixture in an amount of water from 10 to 20 times the total weight of the mixture. The dispersion is coated on the porous sinter plate in several applications with heating between applications to drive off the water. After the desired coating is built up, the electrode is heated to a temperature of about 375° C. under an inert atmosphere to solidify the margin zone and give it a smooth appearance.

Preferably, the finely particulate catalyst is blended in high proportion to the amount of fluorocarbon polymer utilized. A particularly preferred coating composition comprises 93% by weight of a mixture of ruthenium oxide and iridium oxide and 7% by weight polytetrafluoroethylene.

It will be appreciated by those skilled in the art that the electrode of the present invention must be aligned in the electrolysis cell with the surface having the catalyst coating towards the electrolyte.

The electrodes produced in accordance with the present invention are characterized by a particularly high corrosion resistance in an oxidizing environment, simplicity of design, high chemical resistance and favorable decomposition voltage. Due to their economy of manufacture, the electrodes of the invention are particularly advantageous for the production of series of electrodes with large areas for large-scale industrial plants. The subject electrodes further possess good mechanical strength and high chemical resistance.

Wherein the electrodes of the invention have a dense, non-porous zone at the margin, such zone acts to seal and close the electrode within the framework of an electrolysis cell unit, thus enhancing its efficiency.

Having generally described this invention, a further understanding can be obtained by reference to the following specific example which is provided herein for purposes of illustration only and is not intended to be limiting unless otherwise specified.

EXAMPLE

A hollow-cylindrical matrix and a cylindrical die of electrographite (for example, EK 85 made by Ringsdorff-Werke GmbH) with a diameter of 60 mm were covered with bornitride. A total of 5 g of powder having a particle size of 50 microns to 150 microns was charged into the matrix, homogeneously distributed and the die was placed on top. The entire unit was first exposed to a protective gas flow of argon for about 10 minutes. The pressure of the die was increased to 75 bar with continued flow of protective gas. The temperature was successively increased to 820° C. with a speed of heating of 40° C./minute and was maintained on the final value for 10 minutes. The unit was cooled and the sinter body was taken out of the matrix having reached room temperature. The titanium sinter body was again preheated to 200° C. and coated as follows with the catalyst on one side. A finely particulate mixture of 20 percent $RuO_2$ and 80 molar percent $IrO_2$ was homogeneously blended with powdered polytetrafluoroethylene. To 0.5 of the resulting mixture which comprised 93% by weight oxides and 7% by weight polytetrafluoroethylene was added 10 g of water with stirring to effect a uniform suspension. The suspension was uniformly brushed on one side of the porous sinter plate which had been preheated and the temperature raised to 200° C. to drive off the water. In the same manner, two additional coatings of the catalyst suspension were applied. The temperature was then raised to 375° C. under an argon atmosphere for one hour to solidify the catalyst coating.

A predetermined marginal zone of the porous sinter plate was coated with powdered polytetrafluoroethylene in a suitable vacuum chamber. The chamber was evacuated for a predetermined time thereby causing the powdered polytetrafluroethylene to penetrate into the pores of the porous sinter plate in the marginal zone. The process of coating the marginal zone and subjecting the plate to vacuum was repeated three times to assure maximum penetration of the plastic into the pores.

The plate was then heated to 375° C. under an argon atmosphere for one hour to solidify the plastic thus forming a dense, non-porous zone having a smooth appearance.

Having now fully described this invention, it will be apparent to one of ordinary skill in the art that many changes and modifications can be made thereto without departing from the spirit or scope of the invention set forth therein.

What is claimed as new and intended to be covered by Letters Patent is:

1. An electrode for the electrolysis of water comprising a porous sinter plate of titanium or a titanium alloy having on one surface a coating of a finely particulate catalyst consisting essentially of a mixture of ruthenium oxide and iridium oxide; wherein said electrode has at its outer margin a dense, non-porous zone having a smooth appearance wherein the pores in said zone are filled by impregnation with a suitable impregnating substance.

2. An electrode in accordance with claim 1 wherein said porous sinter plate is prepared from titanium or a titanium alloy having a particular size of from about 50 microns to about 150 microns.

3. An electrode in accordance with any of claims 1 or 2 wherein said porous sinter plate is comprised of an alloy of titanium.

4. An electrode in accordance with claim 3 wherein said alloy is 90 molar % titanium, 6 molar % aluminium and 4 molar % vanadium.

5. An electrode in acccordance with claim 1 wherein said impregnating substance is titanium or a titanium alloy.

6. An electrode in accordance with claim 1 wherein said impregnating substance is a suitable plastic material.

7. An electrode in accordance with claim 6 wherein said plastic material is a fluorocarbon polymer.

8. An electrode in accordance with claim 7 wherein said fluorocarbon polymer is polytetrafluoroethylene.

* * * * *